US007150648B1

(12) United States Patent
Hall et al.

(10) Patent No.: US 7,150,648 B1
(45) Date of Patent: Dec. 19, 2006

(54) SURFACE MOUNT ELECTRICAL CONNECTOR

(75) Inventors: John Wesley Hall, Harrisburg, PA (US); James Michael Raudenbush, Halifax, PA (US); Hurley Chester Moll, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/265,217

(22) Filed: Nov. 2, 2005

(51) Int. Cl.
*H01R 9/05* (2006.01)

(52) U.S. Cl. ..... 439/581; 439/63; 439/607

(58) Field of Classification Search ..... 439/63, 439/581, 607

See application file for complete search history.

(56) References Cited

U.S. PATENT DOCUMENTS 4,826,442 A * 5/1989 Douty et al. ..... 439/92
5,046,952 A * 9/1991 Cohen et al. ..... 439/63
5,334,050 A * 8/1994 Andrews ..... 439/579
5,451,158 A 9/1995 Lin et al.
5,487,674 A 1/1996 Guzik et al.
6,045,402 A * 4/2000 Embo et al. ..... 439/579
6,099,334 A * 8/2000 Togashi ..... 439/188
6,227,904 B1 * 5/2001 Wang et al. ..... 439/541.5
6,290,508 B1 * 9/2001 Wu ..... 439/76.1
6,361,332 B1 3/2002 Froude et al.
6,361,348 B1 * 3/2002 Hall et al. ..... 439/352
6,530,787 B1 * 3/2003 Harting et al. ..... 439/83
6,575,761 B1 * 6/2003 Regnier ..... 439/63
6,695,636 B1 2/2004 Hall et al.

* cited by examiner

*Primary Examiner*—Tulsidas C. Patel
*Assistant Examiner*—Harshad C Patel

(57) ABSTRACT

An electrical connector includes an outer shell defining an inner cavity, wherein the outer shell includes a shell alignment element and a solder tab having a substantially flat solder tab engagement surface for surface mounting to a circuit board. An inner member is received within the inner cavity, and the inner member includes a dielectric member having a dielectric alignment element engaging the shell alignment element for positioning the dielectric member with respect to the outer shell. The dielectric member includes a contact cavity extending axially through the dielectric member. A contact is received within the contact cavity, and the contact includes a contact engagement surface for surface mounting to the circuit board. The contact and solder tab engagement surfaces are aligned in a predetermined planar arrangement.

20 Claims, 5 Drawing Sheets

SURFACE MOUNT ELECTRICAL CONNECTOR

BACKGROUND OF THE INVENTION

This invention relates generally to electrical connectors, and, more specifically, to surface mount snap lock electrical connectors for mating engagement with plug connectors.

Many cars include radio antennas that are located on the roof of the car. The antenna or plug connector typically is connected to, and delivers an electric signal to, a jack connector located within the car. The jack connector is typically through hole mounted to a circuit board of a radio. The plug connector and the jack connector are secured to each other in mating contact to form a connector assembly.

However, typical connector assemblies suffer from certain drawbacks. For example, the plug connector may be easily disengaged from the jack connector and thus lose electrical contact therebetween. As such, at least some connector assemblies include a connector locking assembly. The connector locking assembly is configured to be manually operated to release the plug connector from the jack connector. At least some connector locking assemblies have configurations which require that the connectors be mounted by rotating one connector relative to the other connector. This approach may be undesirable in an automobile production environment. Other connector locking assemblies have configurations which employ a snap-on or quick connect, quick disconnect configuration in which the plug connector is simply pushed into mating engagement with the jack connector without mutual rotation. To prevent inadvertent disengagement, at least some connector locking assemblies include a locking collar to retain the plug connector in a locked position.

Other drawbacks to known connector assemblies include possible damage to the jack connectors caused during mating with the plug assembly. For example, large insertion forces may be required to mate the connectors. The insertion force may damage, and possibly destroy the interconnection between the contact and the circuit board at the through hole mounting location. The damage may lead to failure of the connector assembly.

BRIEF DESCRIPTION OF THE INVENTION

In one aspect, an electrical connector is provided including an outer shell defining an inner cavity, wherein the outer shell includes a shell alignment element and a solder tab having a substantially flat solder tab engagement surface for surface mounting to a circuit board. An inner member is received within the inner cavity, and the inner member includes a dielectric member having a dielectric alignment element engaging the shell alignment element for positioning the dielectric member with respect to the outer shell. The dielectric member includes a contact cavity extending axially through the dielectric member. A contact is received within the contact cavity, and the contact includes a contact engagement surface for surface mounting to the circuit board. The contact and solder tab engagement surfaces are aligned in a predetermined planar arrangement.

Optionally, the dielectric member may include an alignment rib extending on an exterior surface thereof, wherein the contact abuts the alignment rib, and the alignment rib is oriented with respect to the solder tab to ensure coplanarity of the contact engagement surface with the solder tab engagement surface. The alignment rib may provide a positive force on the contact in a direction of the circuit board when the contact is received within the contact cavity. In one embodiment, the contact engagement surface is curvilinear such that the contact engagement surface engages the circuit board at a point along the contact engagement surface, and a tangent of the point is coplanar with the solder tab engagement surface. Optionally, the predetermined planar arrangement of the contact and solder tab engagement surfaces is substantially coplanar.

In another aspect, a snap lock electrical connector is provided for mating with a mating plug connector. The electrical connector includes an outer shell defining an inner cavity, wherein the outer shell includes a solder tab having a substantially flat solder tab engagement surface for surface mounting to a circuit board. An inner shell is received within the inner cavity, and the inner shell includes a groove extending circumferentially along an outer surface of the inner shell. The inner shell is configured within the outer shell such that the mating plug connector engages the groove to snap lock the mating plug connector with the electrical connector. A dielectric member is received within the inner shell, and the dielectric member includes a contact cavity extending axially through the dielectric member. A contact is received within the contact cavity, and the contact includes a contact engagement surface for surface mounting to the circuit board.

DETAILED DESCRIPTION OF THE INVENTION

Figure 1:
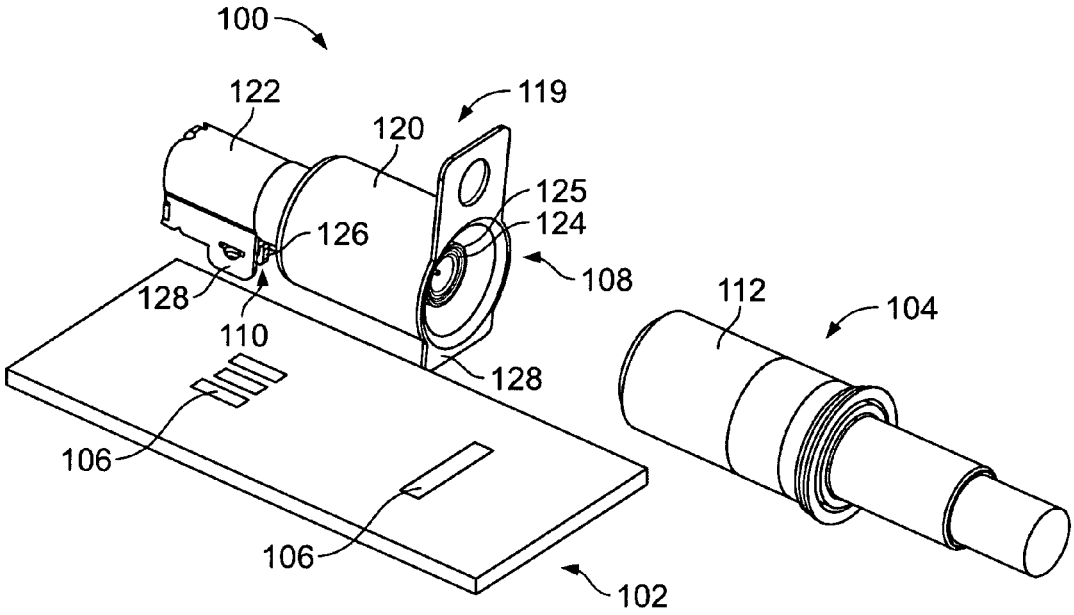
FIG. 1 is a top perspective view of an electrical connector in accordance with an exemplary embodiment of the present invention, a circuit board, and a mating plug connector.

FIG. 1 is a top perspective view of an electrical connector 100 in accordance with an exemplary embodiment of the present invention, a circuit board 102, and a mating plug connector 104. The electrical connector 100 defines a jack connector that is surface mounted to the circuit board 102. Optionally, the electrical connector 100 is coupled to the circuit board 102 by a soldering process. For example, the electrical connector 100 may be soldered to the circuit board 102 at a plurality of predefined solder pads 106. As such, the electrical connector 100 is mechanically and electrically coupled to the circuit board 102. The electrical connector 100 is a right angle connector including a mating portion 108 configured to be mated with the mating plug connector 104 and a mounting portion 110 configured to be mounted to the circuit board 102. The mating portion 108 is oriented generally perpendicular with respect to the mounting portion 110.

The mating plug connector 104 is received within the mating portion 108 of the electrical connector 100. Optionally, the mating plug connector 104 is lockably coupled to the electrical connector 100. For example, the mating plug connector 104 may be a snap locking connector having a collar subassembly 112 that is spring loaded and shiftable relative to an inner shell subassembly (not shown). The collar subassembly 112 may be movable between locked and unlocked positions wherein the inner shell subassembly is configured to deflect radially outward when the collar subassembly is in the unlocked position. During mating, the inner shell subassembly is deflected outward by a portion of the electrical connector 100. When loaded, the collar subassembly 112 may be shifted to a locked position. As such, the mating plug assembly 104 is locked to the electrical connector 100 in the loaded position.

The electrical connector 100 includes an outer shell 119 including a front shell 120 and a rear shell 122, a dielectric member 124 surrounded by an inner shell 125, and a contact 126. In one embodiment, each of the front and rear shells 120 and 122 include solder tabs 128 for coupling the front and rear shells 120 and 122 to the solder pads 106. Each of the solder tabs 128 are aligned with one another along a common plane for surface mounting to the circuit board 102. The contact 126 is also aligned with the solder tabs 128 along the common plane for surface mounting to the circuit board 102.

Figure 2:
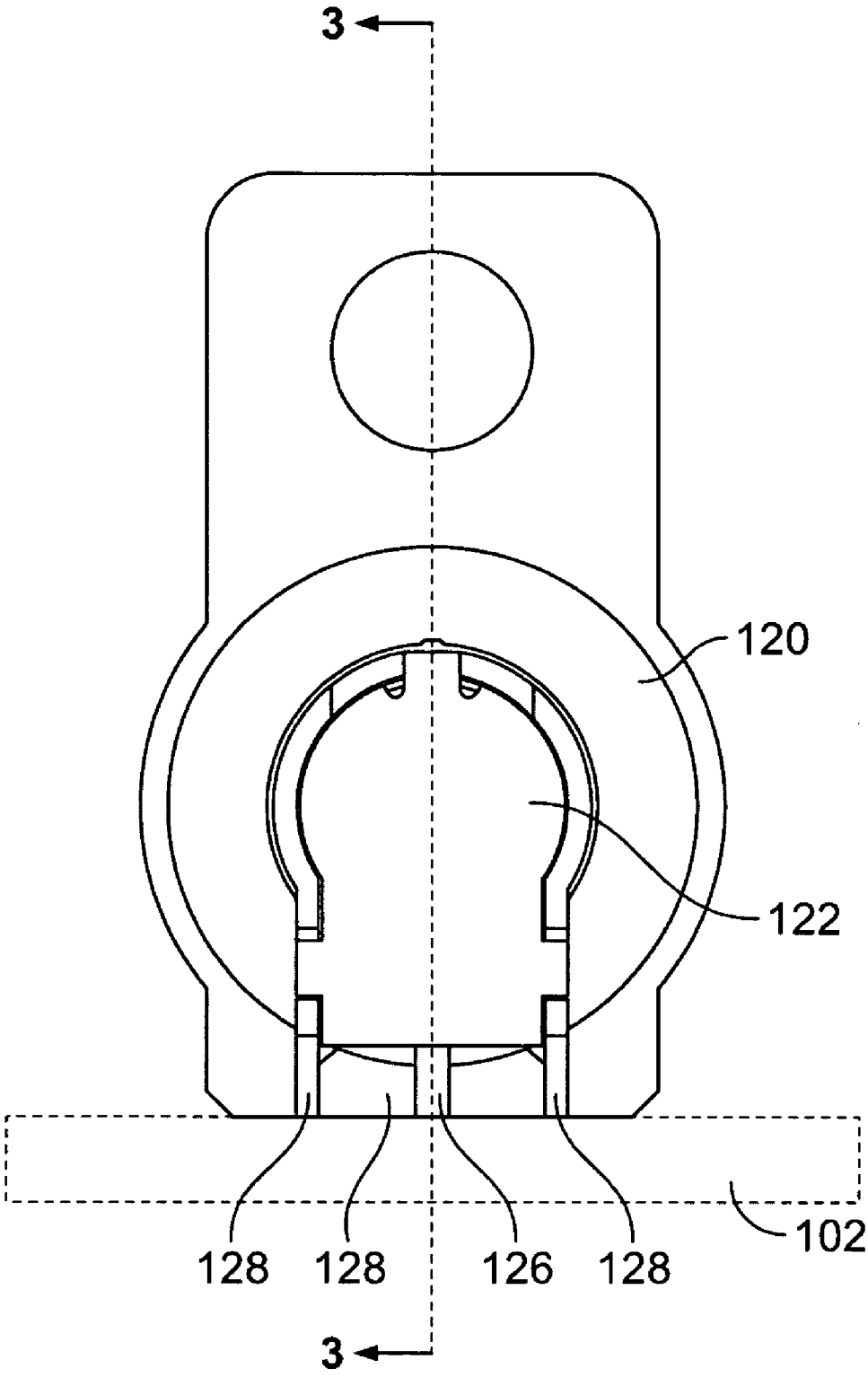
FIG. 2 is a rear view of the electrical connector shown in FIG. 1.

FIG. 2 is a rear view of the electrical connector shown in FIG. 1. FIG. 2 illustrates the coplanarity between the contact 126 and the solder tabs 128 of the rear shell 122 and the solder tab 128 of the front shell 120. The coplanarity ensures reliability of the electrical connector 100 by properly positioning and supporting the electrical connector 100 and by electrically and mechanically coupling the electrical connector 100 to the circuit board 102.

Figure 3:
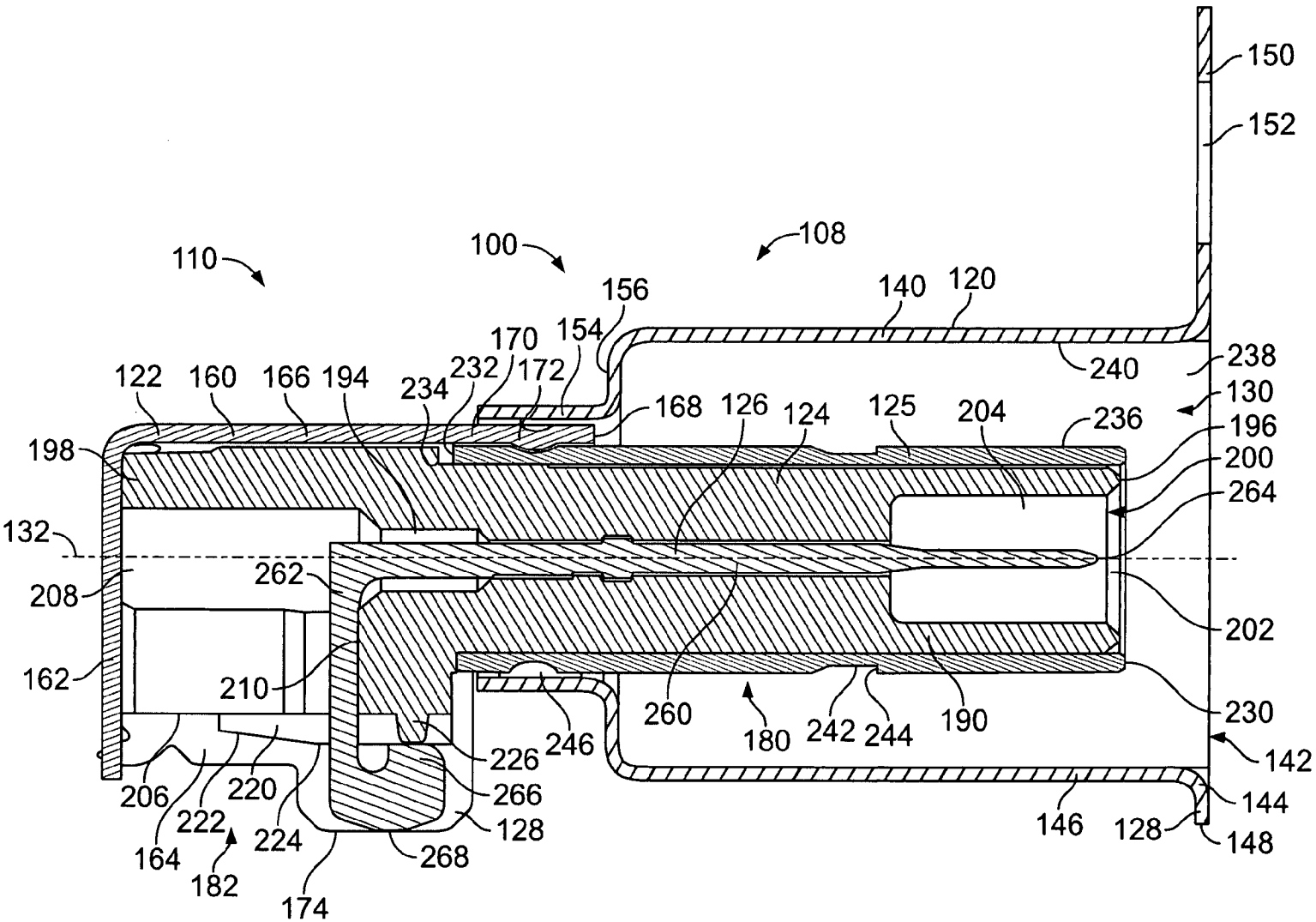
FIG. 3 is a cross sectional view of the electrical connector shown in FIGS. 1 and 2 taken along line 3—3 shown in FIG. 2.

FIG. 3 is a cross sectional view of the electrical connector 100 taken along line 3—3 shown in FIG. 2. As illustrated in FIG. 3, the front, rear and inner shells 120, 122 and 125 are coupled to one another, such as through a crimping process. The dielectric member 124 is positioned within an inner cavity 130 defined within each of the front and rear shells 120 and 122. The inner shell 125 surrounds the dielectric member 124. The inner cavity 130 extends generally along a longitudinal axis 132 of the electrical connector 100. Optionally, the longitudinal axis 132 may extend substantially parallel to the circuit board 102 (shown in FIG. 1) when the electrical connector 100 is mounted to the circuit board.

The front shell 120 includes an outer wall or body 140 extending circumferentially around a front portion of the inner cavity 130. The body 140 is fabricated from a solderable and/or conductive material, such as a metal material. The body 140 defines a bore having a circular cross-section. Alternatively, the cross-section of the body 140 may have another shape such as a rectangular shape, an oval shape, a triangular shape, an irregular shape, or the like. However, the shape is generally complementary to the shape of the mating plug connector 104 (shown in FIG. 1) such that the mating plug connector 104 is received within the front portion of the inner cavity 130. More specifically, the front shell 120 includes a mating plug interface 142 at a front end 144 thereof. The mating plug interface 142 is open, allowing access to the inner cavity 130.

The front shell 120 includes one of the solder tabs 128 along a bottom portion 146 of the front end 144. The bottom portion 146 is defined as the portion of the front shell 120 proximate the circuit board 102 when the electrical connector 100 is mounted to the circuit board 102. The solder tab 128 is downwardly turned from the body 140 such that the body 140 is elevated with respect to the circuit board 102 when mounted thereto. The front shell 120 is supported by the solder tab 128 when mounted to the circuit board 102. The front shell 120 may be supported by the solder tab 128 to provide stability and strain relief during processing and handling. The front shell solder tab 128 includes an engagement surface 148 that is soldered to the circuit board 102. When soldered, the front shell 120 may be electrically grounded to the circuit board 102.

In one embodiment, the front shell 120 also includes a panel mount portion 150. Optionally, the panel mount portion 150 may extend from the front end 144 of the front shell 120 in a direction that is generally opposed from the solder tab 128. Alternatively, the panel mount portion 150 may be positioned at a different location. The panel mount portion 150 includes an opening 152 for through hole attachment of a panel ground attachment member (not shown).

The front shell 120 includes a collar 154 extending axially rearward from a rear end 156 of the front shell 120. The collar 154 extends circumferentially about the longitudinal axis 132. The collar 154 is utilized to couple the front shell 120 to the rear shell 122 and/or the inner shell 125.

The rear shell 122 includes an outer wall or body 160 extending along and defining a rear portion of the inner cavity 130. The body 160 includes a rear wall 162 and side walls 164. The body 160 also includes a top wall 166. Optionally, the rear shell 122 includes an open bottom portion. The top wall 166 extends from the rear wall 162 to a front end 168. A portion of the body 160 proximate the front end 168 defines a collar 170. The collar 170 is sized to fit within the collar 154 of the front shell 120 and surround the inner shell 125. Alternatively, the collar 154 of the front shell 120 may fit within the collar 170 of the rear shell 122. Optionally, when assembled, the inner shell 125 and the collars 154 and 170 may be crimped together to securely couple the front and rear shells 120 and 122 to one another, and to securely couple the front and rear shells 120 and 122 to the inner shell 125. In one embodiment, the collars 154 and/or 170 may include a lip 172 that extends radially inward.

Each side wall 164 of the rear shell 122 includes one of the solder tabs 128 along a bottom portion thereof. Each solder tab 128 extends downwardly from the body 160 such that the body 160 is elevated with respect to the circuit board 102 when mounted thereto. Each solder tab 128 supports the rear shell 122 when mounted to the circuit board 102. The rear shell 122 may be supported by the solder tab 128 to provide stability and strain relief. Each rear shell solder tab 128 includes an engagement surface 174 that is soldered to the circuit board 102 proximate the engagement surface 174. When soldered, the rear shell 122 is electrically grounded to the circuit board 102.

Figure 4:
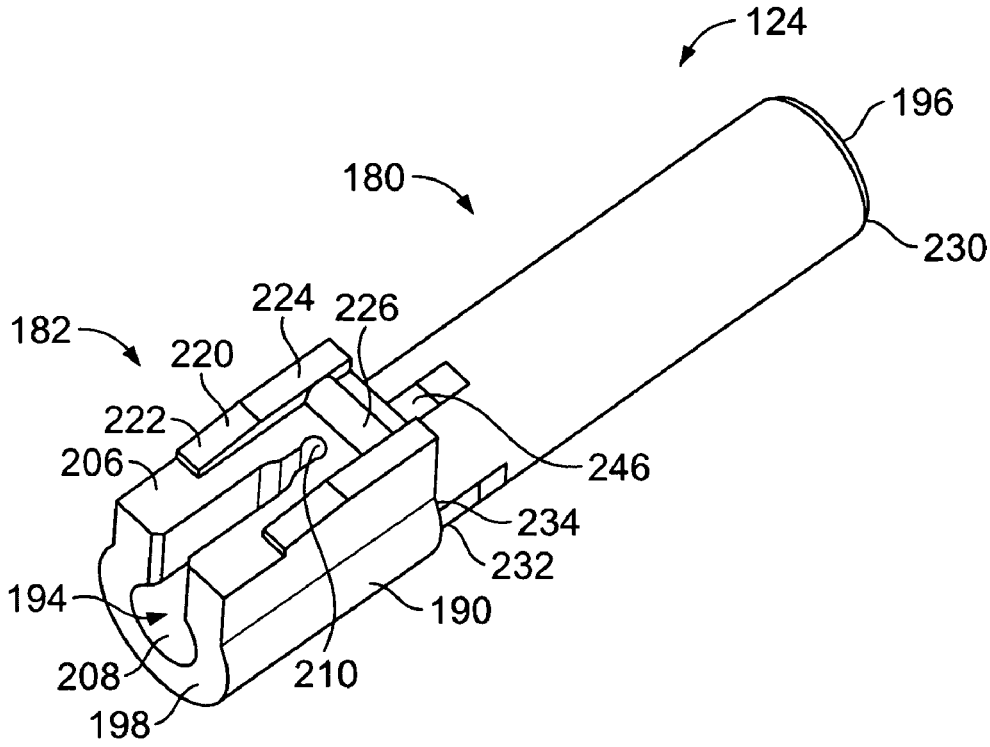
FIG. 4 is a bottom perspective view of a dielectric member of the electrical connector shown in FIGS. 1–3.

FIG. 4 is a bottom perspective view of the dielectric member 124 of the electrical connector 100 shown in FIGS. 1–3. The dielectric member 124 is described herein with reference to both FIGS. 3 and 4. The dielectric member 124 includes a mating portion 180 and a mounting portion 182, which are generally positioned proximate the mating and mounting portions 108 and 110, respectively, of the electrical connector 100. The dielectric member 124 includes an insulative inner body 190 extending along both the mating and mounting portions 180 and 182. The inner shell 125 extends along the mating portion 180 of the inner body 190.

The inner body 190 extends axially along a contact cavity 194 between a front end 196 and a rear end 198. The mating portion 180 extends rearward from the front end 196 and has a substantially circular cross-section. At the front end 196, a mating plug interface 200 extends along an opening 202 providing access to an inner mating plug cavity 204. A portion of the mating plug connector 104 (shown in FIG. 1) is received within the inner mating plug cavity 204 when the mating plug connector is mated with the electrical connector 100. Optionally, the inner body 190 is chamfered at the opening 202. The mounting portion 182 extends forward from the rear end 198. The mounting portion 182 has a bulbous upper portion which extends generally along the longitudinal axis 132. The mounting portion 182 also includes a box shaped lower portion having a bottom surface 206. The contact cavity 194 is open at the rear end 198 of the inner body 190 to deliver a loading end 208 of the contact cavity 194. During assembly, the contact 126 is loaded into the dielectric member 124 through the loading end 208. The contact cavity 194 is also open at the bottom surface 206 such that the contact 126 may extend from the contact cavity 194 to an exterior of the dielectric member 124. An abutment surface 210 is defined at the forward-most end of the contact cavity 194 within the mounting portion 182.

As best illustrated in FIG. 4, ramp members 220 extend perpendicularly outward from the bottom surface 206. The ramp members 220 define dielectric alignment elements. The ramp members 220 have an inclined surface 222 and a substantially flat base 224. Optionally, the base 224 may be oriented substantially parallel to the bottom surface 206. Additionally, an alignment member 226 extends perpendicularly outward from bottom surface 206. The alignment member 226 is positioned forward of and is substantially aligned with an open bottom portion of the contact cavity 194. As such, when the contact 126 is loaded into the contact cavity 194, the contact 126 engages the alignment member 226. Optionally, the alignment member 226 extends between the ramp members 220. The outer surface of the alignment member 226 is rounded or radiused to facilitate assembly as the contact 126 moves along the outer surface of the alignment member 226. In one embodiment, the alignment member 226 is coplanar with the base 224 of the ramp members 220.

Returning to FIG. 3, the inner shell 125 of the dielectric member 124 extends axially along and circumscribes the inner body 190 of the dielectric member 124. The inner shell 125 extends between a front end 230 and a rear end 232. The front end 230 is substantially aligned with the front end 196 of the inner body 190. The rear end 232 of the inner shell 125 abuts a ledge 234 of the inner body 190. Optionally, the ledge 234 separates the mating and mounting portions 180 and 182 of the dielectric member 124.

The conductive inner shell 125 defines a radially inner surface 236 of an outer plug cavity 238. A radially outer surface 240 of the outer plug cavity 238 is defined by the front shell 120. The mating plug connector 104 is received within the outer plug cavity 238. A portion of the mating plug connector 104 engages the conductive inner shell 125 of the dielectric member 124 along a jack-plug interface. In one embodiment, the inner shell 125 includes a circumferential groove 242 having a shoulder 244 at a forward-most end of the groove 242. When the mating plug connector 104 is received within the outer plug cavity 238, a portion of the mating plug connector 104 may be locked within the groove 242 and the shoulder 244 may resist removal of the mating plug connector 104. The inner shell 125 may also include notched-out portions 246 proximate the rear end 232 of the inner shell 125. The notched-out portions 246 receive the lip 172 of the rear shell 122 to facilitate retaining the rear shell 122 and the dielectric member 124 in a coupled relationship.

The contact 126 includes a contact section 260 and a solder tail section 262. The contact 126 is received within the contact cavity 194 such that the contact section 260 is generally received within the mating portion 180 of the dielectric member 124 and the solder tail section 262 is generally received within the mounting portion 182 of the dielectric member 124. The contact section 260 extends parallel to the longitudinal axis 132 and includes a mating end 264 positioned within the inner mating plug cavity 204 of the dielectric member 124. As such, the mating end 264 is positioned to interface with the mating plug connector 104 when the mating plug connector 104 is mated with the electrical connector 100.

The solder tail section 262 is oriented generally perpendicular to the contact section 260 thus allowing the electrical connector 100 to function as a right angle connector. Optionally, a portion of the solder tail section 262 may engage the abutment surface 210 of the dielectric member 124 when the contact 126 is fully loaded into the contact cavity 194. The solder tail section 262 includes a rounded end 266 engaging the alignment member 226. An engagement surface 268 is generally opposed from the rounded end 266 and is aligned in a predetermined planar arrangement with respect to the solder tabs 128. Optionally, the engagement surface 268 is aligned along a common plane with the solder tabs 128, such that the engagement surfaces 268, 148, 174 are substantially coplanar. Alternatively, the engagement surfaces 268, 148, 174 may be positioned on different planes, such as, for example, when the solder pads 106 (shown in FIG. 1) are on different planes. The engagement surface 268 is curvilinear to accommodate misalignment of the contact 126 with the circuit board 102. The solder tail section 262 is sized to facilitate establishing the planar relationship of the engagement surface 268 and the engagement surfaces 148, 174 of the solder tabs 128. For example, the thickness of the solder tail section 262 between the end 266 and the engagement surface 268 is selected to be substantially equal to the spacing between the alignment member 226 and the engagement surfaces 148, 174 of the solder tabs 128. As a result, the engagement surfaces 268, 148, 174 are substantially coplanar.

Figure 5:
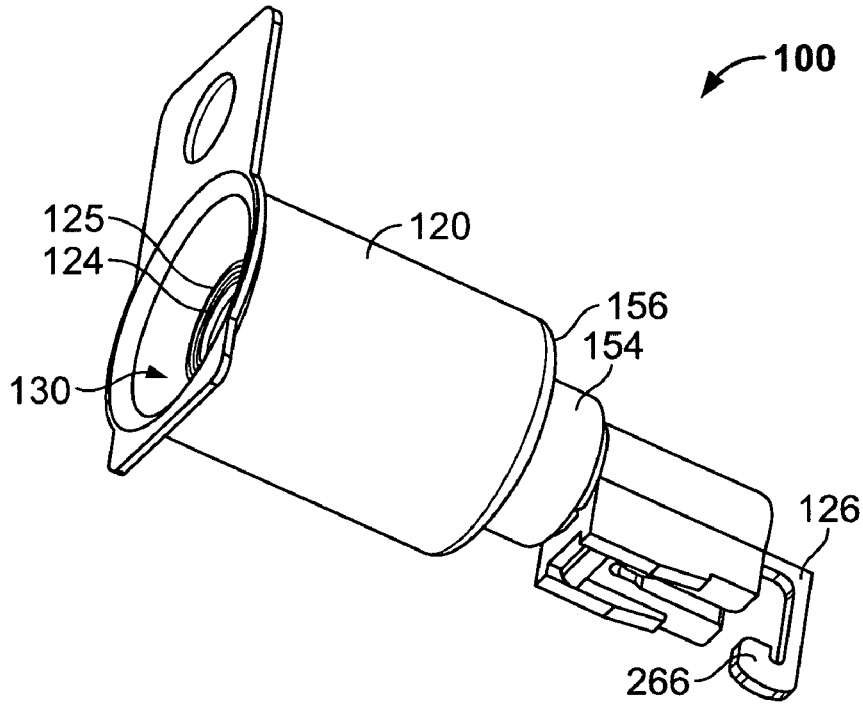
FIG. 5 is a partially assembled view of the electrical connector shown in FIG. 1.
Figure 6:
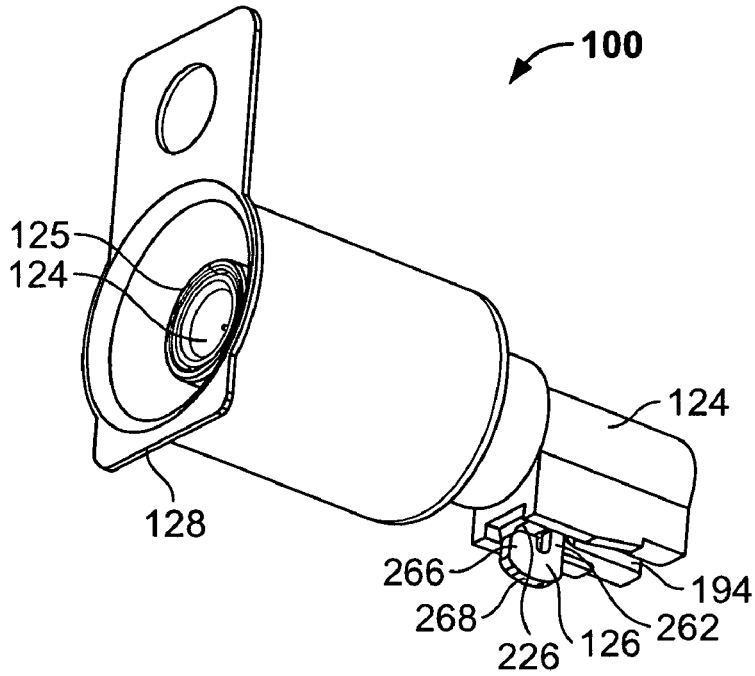
FIG. 6 is another partially assembled view of the electrical connector shown in FIG. 1.
Figure 7:
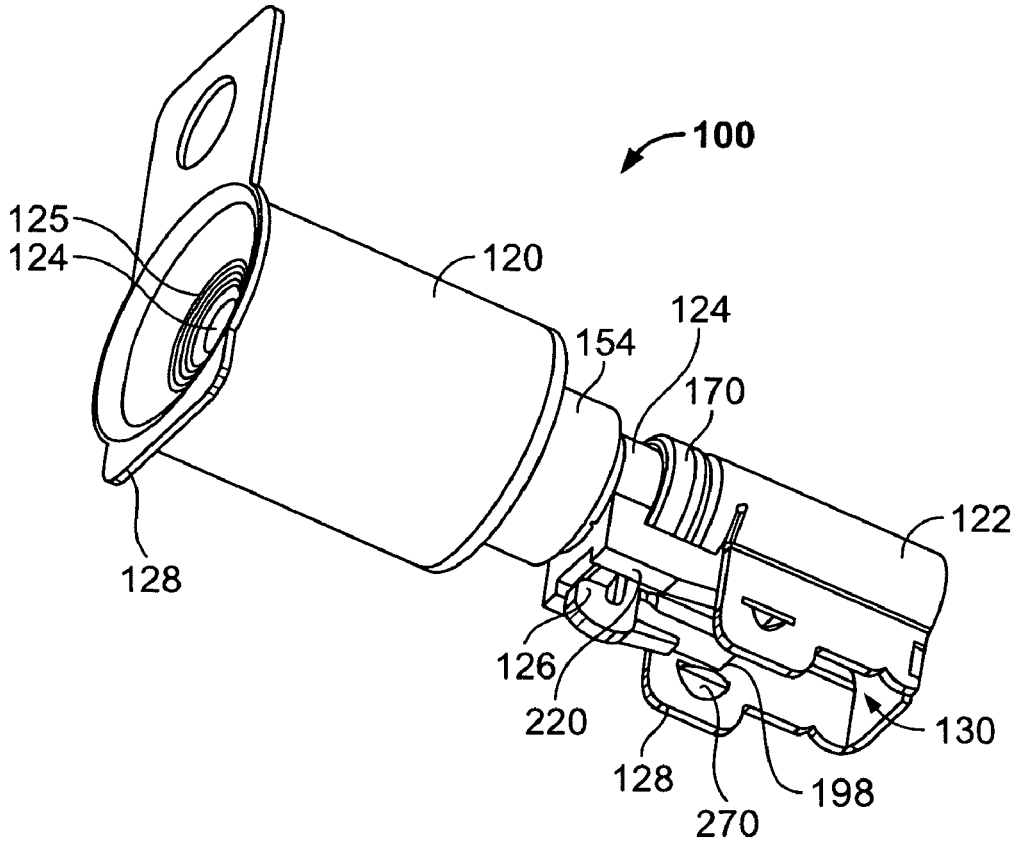
FIG. 7 is yet another partially assembled view of the electrical connector shown in FIG. 1.

An exemplary assembly process is described below with reference to FIGS. 5–7. FIG. 5 is a partially assembled view of the electrical connector 100 illustrating the contact 126 partially loaded into the dielectric member 124. FIG. 6 is another partially assembled view of the electrical connector 100 illustrating the contact 126 fully loaded into the dielectric member 124. FIG. 7 is yet another partially assembled view of the electrical connector 100 illustrating the rear shell 122 partially loaded onto the dielectric member 124.

With reference to FIG. 5, the initial assembly of the electrical connector 100 includes loading the dielectric member 124 into the inner shell 125 and positioning the dielectric member 124 and inner shell 125 unit within the inner cavity 130 of the front shell 120. Optionally, the dielectric member 124 and inner shell 125 may be loaded through the rear end 156 and collar 154. The contact 126 is then loaded through the loading end 208 of the dielectric member 124. The contact 126 is generally positioned such that the rounded end 266 of the solder tail section 262 is positioned along the bottom surface 206 of the dielectric member 124. Alternatively, the contact 126 may be loaded into the dielectric member 124 prior to positioning the dielectric member 124 within the front shell 120.

With reference to FIG. 6, the contact 126 is shifted from the un-loading position (shown in FIG. 5) to a loaded position wherein the contact 126 is fully received within the contact cavity 194. The solder tail section 262 abuts the abutment surface 210 (shown in FIG. 3) of the dielectric member 124. Additionally, the rounded end 266 of the solder tail section 262 engages the alignment member 226. Optionally, during the loading of the contact 126, the rounded end 266 is biased outward by the alignment member 226. As such, movement of the contact 126 is limited because of a positive force or a friction fit between the contact 126 and the alignment member 226. Additionally, the engagement surface 268 is forced in the direction of the circuit board 102 (shown in FIG. 1) and is positioned coplanar with the solder tabs 128.

With reference to FIG. 7, the rear shell 122 is loaded onto the dielectric member 124 after the contact 126 is in the loaded position. The rear shell 122 is loaded onto the rear end 198 of the dielectric member 124 and shifted forward. The rear shell 122 includes ramp engagement members or shoulders 270 extending inward toward the inner cavity 130. The shoulders 270 define rear shell 122 alignment elements. The shoulders 270 are positioned to interface with the ramp members 220 as the rear shell 122 is shifted forward toward the front shell 120. The shoulders 270 ride along the inclined surface 222 to the flat base 224 of the ramp members 220. When the rear shell 122 is fully loaded, the rear shell 122 is coupled to the dielectric member 124 by a positive force or a friction fit between the shoulders 270 and the ramp members 220. Additionally, when the rear shell 122 is fully loaded, the collar 170 of the rear shell 122 is received within the collar 154 of the front shell 120 and surrounds the inner shell 125 (as shown in FIG. 3). As such, the rear shell 122 and the dielectric member 124 are positioned with respect to one another to ensure coplanarity of the contact 126 and solder tabs 128. Alternatively, the rear shell 122 may be coupled to the dielectric member 124 and/or inner shell 125 prior to loading the dielectric member 124 and the inner shell 125 unit into the front shell 120.

The assembled electrical connector 100 (shown in FIG. 1) is then surface mounted to the circuit board 102 (shown in FIG. 1) and is configured to receive the mating plug connector 104 (shown in FIG. 1). The coplanarity of the contact 126 and the solder tabs 128 may be provided within the tolerance allowed in the particular industry. Optionally, the mating plug connector 104 is snap locked to the electrical connector 100.

While the invention has been described in terms of various specific embodiments, those skilled in the art will recognize that the invention can be practiced with modification within the spirit and scope of the claims.

What is claimed is:

1. An electrical connector comprising:

an outer shell defining an inner cavity, said outer shell comprising a shell alignment element and a solder tab having a substantially flat solder tab engagement surface for surface mounting to a circuit board;

an inner member received within said inner cavity, said inner member comprising a dielectric member comprising a dielectric alignment element engaging said shell alignment element for positioning said dielectric member with respect to said outer shell, said dielectric member comprising an alignment member extending on an exterior surface thereof, said dielectric member comprising a contact cavity extending axially through said dielectric member; and a contact received within said contact cavity and abutting said alignment member, said contact comprising a contact engagement surface for surface mounting to the circuit board, said contact abutting said aliment member such that said alignment member aligns said contact and solder tab engagement surfaces in a predetermined planar arrangement.

2. The electrical connector of claim 1 wherein said alignment member oriented with respect to the solder tab to ensure coplanarity of the contact engagement surface with the solder tab engagement surface.

3. The electrical connector of claim 1 wherein said contact is biased against said alignment member when said contact is received within said contact cavity, said contact is biased in a direction toward the circuit board.

4. The electrical connector of claim 1 wherein said alignment member provides a positive force on said contact in a direction of the circuit board when said contact is received within said contact cavity.

5. The electrical connector of claim 1 wherein said contact engagement surface is curvilinear such that said contact engagement surface engages the circuit board at a point along said contact engagement surface, and a tangent of the point is coplanar with said solder tab engagement surface.

6. The electrical connector of claim 1 wherein said shell alignment element comprises a shoulder extending into said inner cavity, said dielectric alignment element comprises a ramp engaging said shoulder for positioning said dielectric member within said inner cavity.

7. The electrical connector of claim 1 wherein the predetermined planar arrangement of said contact and solder tab engagement surfaces is substantially coplanar.

8. An electrical connector comprising:

an outer shell defining an inner cavity said outer shell comprising a shell alignment element and a solder tab having a solder tab engagement surface for surface mounting to a circuit board; an inner member received within said inner cavity, said inner member comprising a dielectric member comprising a dielectric alignment element engaging said shell alignment element for positioning said dielectric member with respect to said outer shell, said dielectric member comprises a groove extending circumferentially along an outer surface of said dielectric member, said dielectric member being configured within said outer shell such that a mating plug connector engages said groove to snap lock the mating plug connector with said surface mount electrical connector, and said dielectric member comprises a contact cavity extending axially through said dielectric member; and a contact received within said contact cavity, said contact comprising a contact engagement surface for surface mounting to the circuit board.

9. The electrical connector of claim 1 wherein said outer shell comprises a front shell and a rear shell, said front shell comprising a collar and said rear shell comprising a collar, said rear shell collar is received in said front shell collar.

10. The electrical connector of claim 9 wherein said front shell comprises said solder tab, said rear shell comprises opposed solder tabs extending toward the circuit board, each solder tab having a solder tab engagement surface oriented substantially coplanar with said contact engagement surface.

11. The electrical connector of claim 1 wherein said solder tab is electrically grounded to the circuit board.

12. A snap lock electrical connector for mating with a mating plug connector, said electrical connector comprising:

an outer shell defining an inner cavity, said outer shell comprising a solder tab having a substantially flat solder tab engagement surface for surface mounting to a circuit board;

an inner shell received within said inner cavity, said inner shell comprises a groove extending circumferentially along an outer surface of said inner shell, said inner shell being configured within said outer shell such that the mating plug connector engages said groove to snap lock the mating plug connector with said electrical connector;

a dielectric member received within said inner shell, said dielectric member comprises an alignment member, and said dielectric member comprising a contact cavity extending axially through said dielectric member; and a contact received within said contact cavity, said contact comprising a contact engagement surface for surface mounting to the circuit board, wherein said contact is biased against said alignment member when said contact is received within said contact cavity, said contact is biased in a direction toward the circuit board.

13. The snap lock electrical connector of claim 12 wherein, said contact abuts said alignment member, and wherein said alignment member is oriented with respect to said solder tab to ensure coplanarity of said contact engagement surface with said solder tab engagement surface.

14. The snap lock electrical connector of claim 12 wherein said alignment member provides a positive force on said contact in a direction of the circuit board when said contact is received within said contact cavity.

15. The snap lock electrical connector of claim 12 wherein said contact engagement surface is curvilinear such that said contact engagement surface engages the circuit board at a point along said contact engagement surface, and a tangent of the point is substantially coplanar with said solder tab engagement surface.

16. The snap lock electrical connector of claim 12 wherein said outer shell comprises a shell alignment element extending into said inner cavity, said dielectric member comprising a dielectric alignment element engaging said shell alignment element for positioning said dielectric member with respect to said outer shell.

17. The snap lock electrical connector of claim 12 wherein said outer shell comprises a front shell and a rear shell, said front shell comprising a collar and said rear shell comprising a collar, said rear shell collar is received in said front shell collar.

18. The snap lock electrical connector of claim 17 wherein said front shell comprises said solder tab, said rear shell comprises opposed solder tabs extending toward the circuit board, each solder tab having a solder tab engagement surface oriented substantially coplanar with said contact engagement surface.

19. The snap lock electrical connector of claim 12 wherein said solder tab is electrically grounded to the circuit board.

20. The electrical connector of claim 8 wherein said dielectric member comprises an alignment member extending on an exterior surface thereof, said contact abutting said alignment member, said alignment member oriented with respect to the solder tab to ensure coplanarity of the contact engagement surface with the solder tab engagement surface.

* * * * *